United States Patent [19]

Gavronsky

[11] Patent Number: 4,518,207

[45] Date of Patent: May 21, 1985

[54] MODULE LATCHING MECHANISM

[75] Inventor: German Gavronsky, Stamford, Conn.

[73] Assignee: Pitney Bowes Inc., Stamford, Conn.

[21] Appl. No.: 541,832

[22] Filed: Oct. 14, 1983

[51] Int. Cl.[3] ..... A47B 87/00

[52] U.S. Cl. ..... 312/107.5; 312/111

[58] Field of Search ..... 312/107, 107.5, 111, 312/250; 220/23.4; 206/504

[56] References Cited

U.S. PATENT DOCUMENTS 3,356,434 12/1967 Theodores ..... 312/250

4,433,881 2/1984 Witten et al. ..... 312/111

*Primary Examiner*—Victor N. Sakran

*Assistant Examiner*—Joseph Falk

*Attorney, Agent, or Firm*—Lawrence E. Sklar; William D. Soltow, Jr.; Albert W. Scribner

[57] ABSTRACT

A latching mechanism for releasably joining and locking together two separate modules located on a flat surface. The latching mechanism includes a first module having a pair of lower fingers projecting therefrom and a pair of upper angular, locking members projecting therefrom, a second module having a pair of lower apertures for locking engagement with the pair of lower fingers and a pair of upper apertures for locking engagement with the pair of upper, angular, locking members and a cam rotatably mounted in the lower portion of the first module. The cam has a shape such that rotation of the cam is effective to lower the first module onto the second module to thereby join the two modules and continued rotation of the cam is effective to urge the second module upwardly against the first module to thereby rigidly lock together the two modules.

2 Claims, 5 Drawing Figures

MODULE LATCHING MECHANISM

BACKGROUND OF THE INVENTION

The instant invention relates to a latching mechanism for releasably joining and locking together two separate modules located on a flat surface, and more particularly to such a latching mechanism which is manually operable in modular office equipment.

It is the current trend to offer office equipment in modular form so that users thereof can put together the particular combination of features that they desire. It therefore becomes important that the various modules have the capability of rigidly locking to each other and being easily releasable.

The prior art is replete with various latching mechanisms which releasably join and lock together two separate modules which are located on a flat surface. However, virtually all of these prior art latching mechanisms involve more than one motion in order to join or separate the two modules, or if only one motion is required, the lock obtained thereby lacks the rigidity required in certain applications.

The foregoing problems associated with locking mechanisms for modules, and particularly office machine modules, are overcome by the instant invention which provides a latching mechanism that rigidly locks the modules together in one continuous motion and similarly provides an easy release of the one module from the other in one continuous motion.

SUMMARY OF THE INVENTION

Accordingly, the instant invention provides a latching mechanism for releasably joining and locking together two separate modules located on a flat surface. The latching mechanism includes a first module having a pair of lower fingers projecting therefrom and a pair of upper angular, locking members projecting therefrom, a second module having a pair of lower apertures for locking engagement with the pair of lower fingers and a pair of upper apertures for locking engagement with the pair of upper, angular, locking members and a cam rotatably mounted in the lower portion of the first module. The cam has a shape such that rotation of the cam is effective to lower the first module onto the second module to thereby join the two modules and continued rotation of the cam is effective to urge the second module upwardly against the first module to thereby rigidly lock together the two modules.

DETAILED DESCRIPTION

Figure 1:
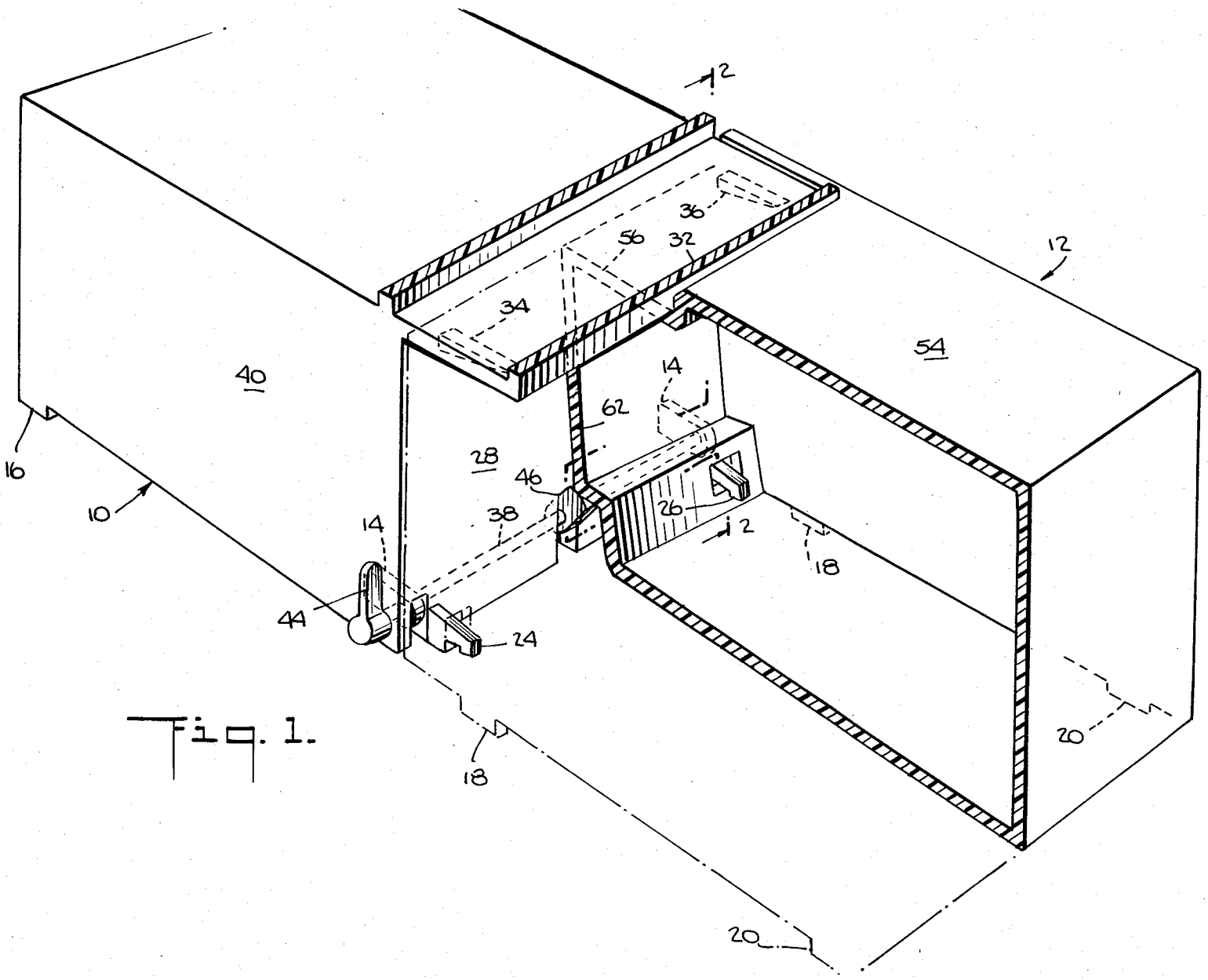
FIG. 1 is a perspective view, partially broken, showing two modules rigidly joined to one another.

In describing the preferred embodiment of the instant invention, reference is made to the drawings, wherein there is seen a first module generally designated 10 and a second module generally designated 12. The first module 10 is supported by a pair of rotary, front legs 14 and a pair of stationary, rear legs 16, while the second module 12 is supported by a pair of stationary, front legs 18 and a pair of stationary, rear legs 20, all of which rest on a flat, horizontal, supporting surface 22.

The first module 10 includes a pair of lower fingers 24 and 26 projecting outwardly from the front panel 28 of the first module 10. Extending outwardly from the first module 10 in the same direction as the fingers 24 and 26 is an overhanging member 30 which terminates in a vertical flange 32. Extending from the under-surface of the overhanging member 30 are a pair of angular projections 34 and 36. A shaft 38 is rotatably mounted in the sidewalls 40 and 42 of the first module 10. The shaft 38 includes a handle 44 for manual rotation thereof and is fixedly secured to the pair of rotary, front legs 14 supporting the first module 10. Fixedly mounted in the middle of the shaft 38 is a cam 46 which, together with the rotary front legs 14, is rotatable when the handle 44 of the shaft 38 is rotated. The effects of the rotation will be discussed further hereinbelow.

Figure 4:
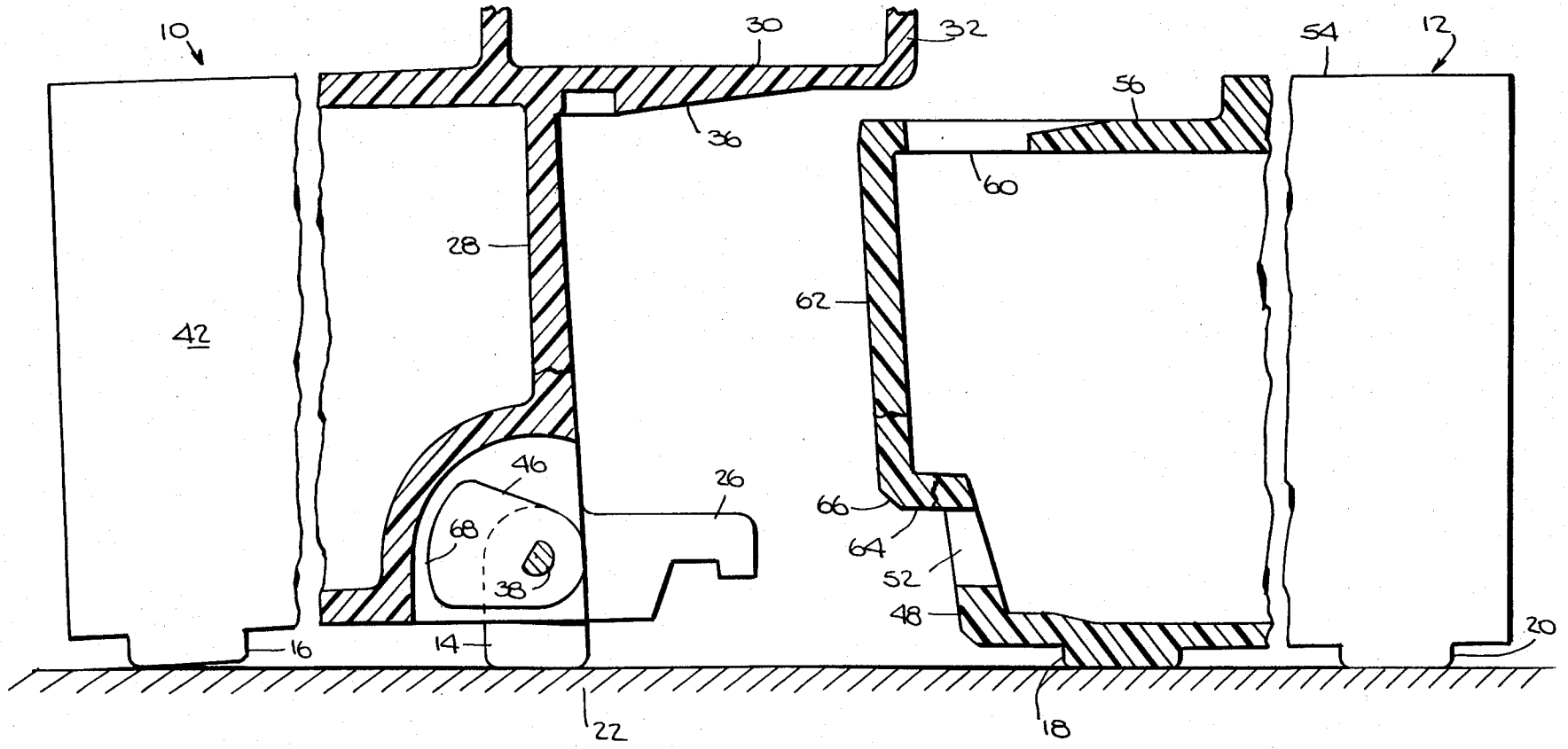
FIG. 4 is identical to FIG. 3 except that the two modules have now been separated.

The second module 12 includes a lower front wall section 48 which includes a pair of lower apertures 50 and 52 which engage the fingers 24 and 26 respectively of the first module 10. The top wall 54 of the second module 12 includes a recessed panel 56 which contains a pair of angular slots 58 and 60 which engage the angular projections 34 and 36 respectively of the first module 10. As best seen in FIG. 4, the second module 12 includes a front panel 62 and a recessed, horizontal section 64. The juncture of the front panel 62 and the horizontal section 64 is beveled in the middle to form a camming plane 66 which engages the cam 46 in a manner to be described more fully hereinafter.

Figure 5:
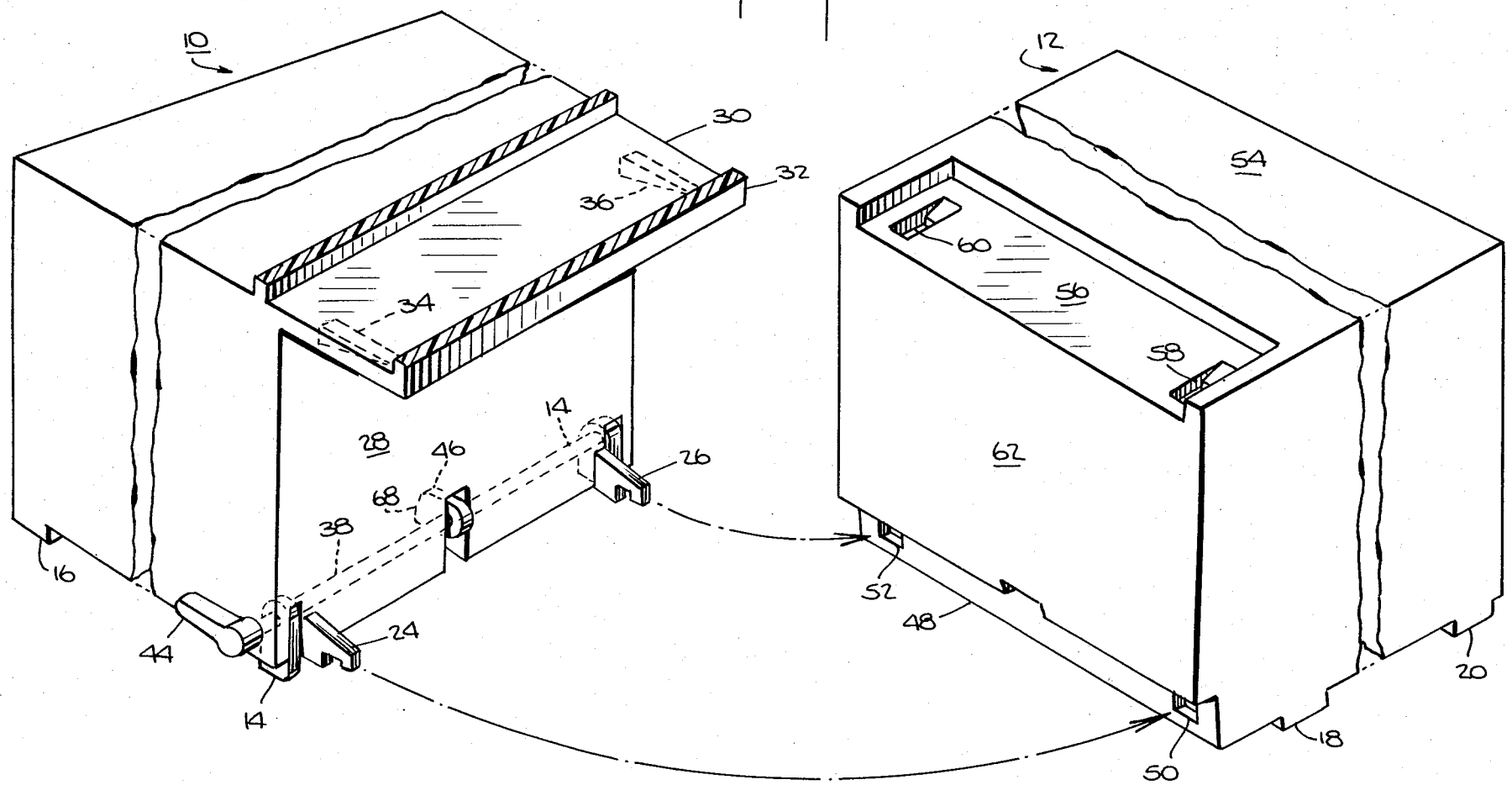
FIG. 5 is a perspective view of the two modules separate and apart from one another.

The manner of latching together the two modules 10 and 12 is best understood by referring first to FIG. 5, in which the two modules 10 and 12 are seen in a separated condition, which is representative of how they would appear either subsequent to their separation or prior to their being latched together. It should be noted that in the separated condition, the rotary, front legs 24 and 26 of the first module 10 are facing downward toward the supporting surface 22 in order to support the first module 10 in an upright position on all four of its legs 14 and 16. FIG. 4 is representative of the two modules 10 and 12 immediately prior to their being latched together or immediately subsequent to their being separated. The position of the shaft 38 in FIG. 4 is identical to position seen in FIG. 5 and thus the rotary front legs 14 and the cam 46 are in the same positions in FIGS. 4 and 5.

Figure 2:
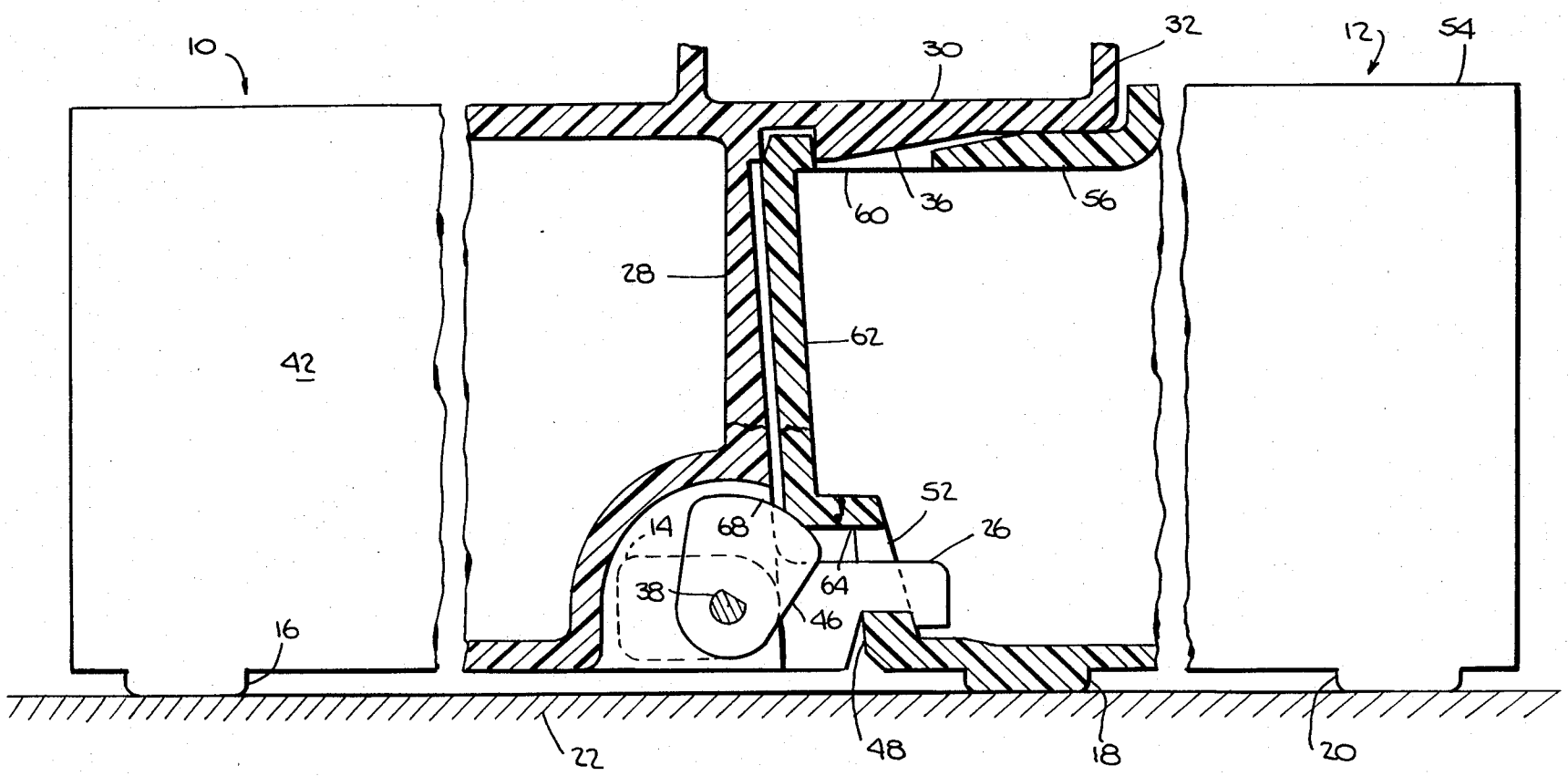
FIG. 2 is a sectional view taken on the planes indicated by the lines 2—2 in FIG. 1.
Figure 3:
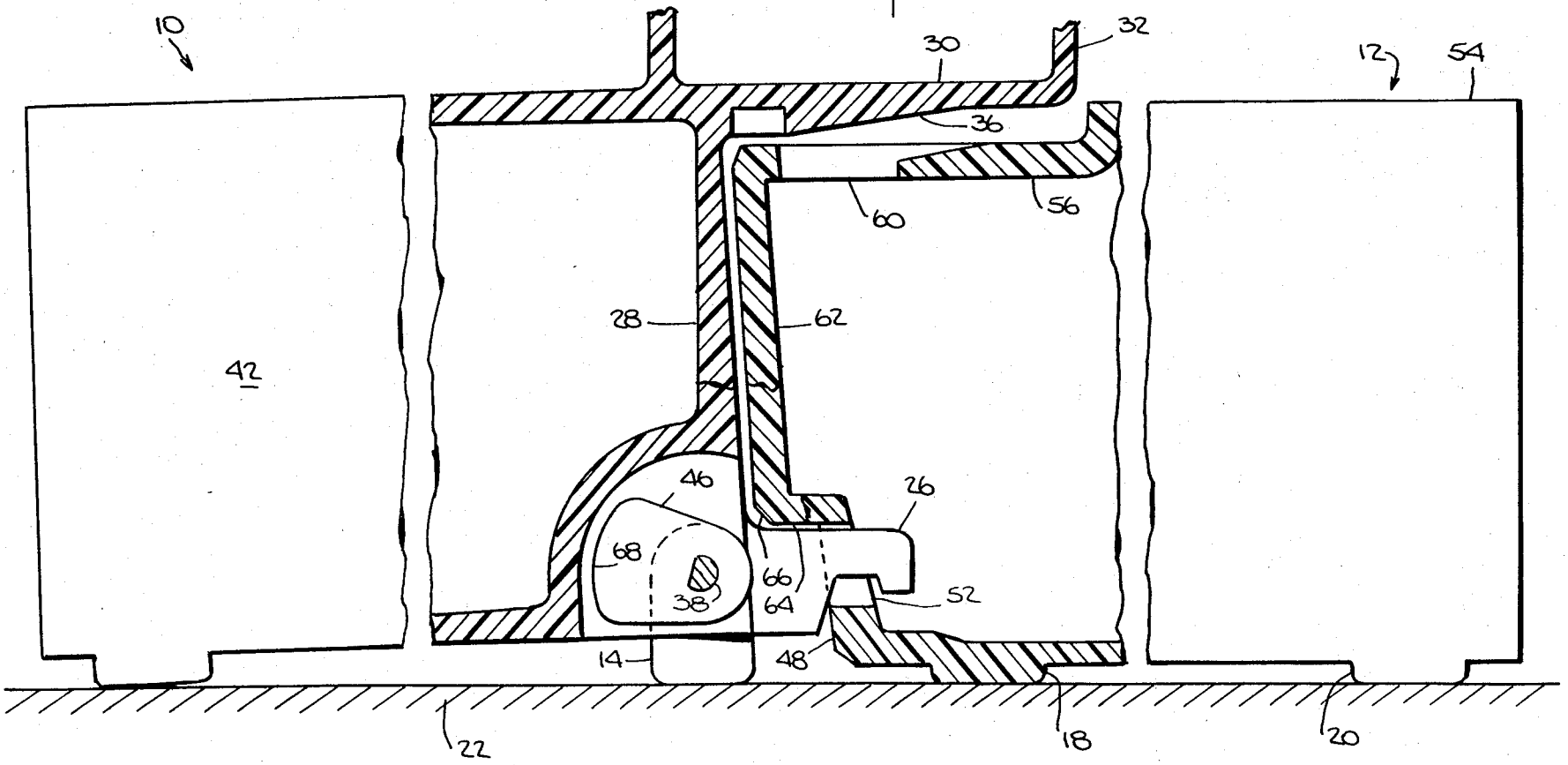
FIG. 3 is the same as FIG. 2 except that the cam has been rotated counterclockwise to thereby raise the left side module with respect to the right side module preparatory to separation of the two modules.

FIG. 3 shows the two modules 10 and 12 as they appear either immediately subsequent to their being separated or immediately prior to their being latched together. It can be seen that the lower fingers 24 and 26 of the first module 10 have entered the apertures 50 and 52 respectively of the second module 12 and that the angular projections 34 and 36 of the first module 10 are poised over the angular slots 58 and 60 respectively of the second module 12. In FIG. 2 the two modules 10 and 12 are finally latched together. The latching is brought about by a counterclockwise rotation of the shaft handle 44 which causes the shaft 38 to rotate counterclockwise which in turn effects counterclockwise rotation of the rotary, front legs 14 and the cam 46. The rotation of the rotary, front legs 14 causes them to be lifted away from the supporting surface 22, the result being that the first module 10 is lowered onto the second module 12. Continued rotation of the shaft 38 eventually brings the surface portion 68 of the cam 46 having the largest radius into butting engagement with the camming plane 66 of the second module 12. This butting engagement results in the second module 12 being forced upwardly against the first module 10 as seen in FIG. 2. Thus, by virtue of merely rotating the shaft 38, the first module 10 is lowered onto the second module 12 and then the second module 12 is urged upwardly against the first module 10, thereby rigidly locking together the two modules 10 and 12.

Although the present invention has been described in detail with respect to certain preferred embodiments thereof, it is apparent to those of skill in the art that variations and modifications in this detail may be effected without any departure from the spirit and scope of the present invention, as defined in the appended claims below.

What is claimed is:

1. A latching mechanism for releasably joining and locking together two separate modules located on a flat surface, comprising:

a first module having a pair of lower fingers projecting therefrom and a pair of angular, locking members projecting therefrom, said first module also having a shaft rotatably mounted in the lower portion of said first module and a pair of rotary front legs and a pair of stationary rear legs, said rotary front legs being fixedly secured to said shaft;

a second module having a pair of lower apertures for locking engagement with said pair of lower fingers and a pair of upper apertures for locking engagement with said pair of angular, locking members; and said front legs operative to abut said flat surface, thereby supporting the front of the module in a raised position, said first module having an overhanging portion extending along the front thereof that is adapted to extend above a recessed portion of the second module, a cam fixedly secured to said shaft at an angular displacement from said front legs, said second module having a cam follower surface, wherein rotation of said shaft effects rotation of said rotary, front legs from said supporting position to thereby lower said first module from said raised position onto said second module when the lower fingers engage the lower apertures, and wherein continued rotation of said shaft effects continued rotation of said cam causing the cam to abut the cam follower surface to thereby urge and the recessed portion of said second module upwardly against the overhanging portion of said first module, causing said two modules to be rigidly locked together.

2. The latching mechanism of claim 1, wherein said shaft includes a handle for manual rotation thereof.

* * * * *